United States Patent [19]

Vinegar et al.

[11] Patent Number: 4,542,648

[45] Date of Patent: Sep. 24, 1985

[54] METHOD OF CORRELATING A CORE SAMPLE WITH ITS ORIGINAL POSITION IN A BOREHOLE

[75] Inventors: Harold J. Vinegar; Scott L. Wellington, both of Houston, Tex.

[73] Assignee: Shell Oil Company, Houston, Tex.

[21] Appl. No.: 566,611

[22] Filed: Dec. 29, 1983

[51] Int. Cl.[4] ..... E21B 49/00

[52] U.S. Cl. ..... 73/153

[58] Field of Search ..... 73/153, 151; 250/363 S; 364/422

[56] References Cited

U.S. PATENT DOCUMENTS

| | | | |
|---|---|---|---|
| 4,029,963 | 6/1977 | Alvarez et al. | 250/360 |
| 4,263,509 | 4/1981 | Fertl et al. | 73/153 X |
| 4,312,040 | 1/1982 | Tinch et al. | 73/151 X |

*Primary Examiner*—Jerry W. Myracle

[57] ABSTRACT

A method of correlating a core sample with its original position in a borehole. The borehole is logged to determine the bulk density of the formation surrounding the borehole. The core sample is scanned with a computerized axial tomographic scanner (CAT) to determine the attenuation coefficients at a plurality of points in a plurality of cross sections along the core sample. The bulk density log is then compared with the attenuation coefficients to determine the position to which the core sample correlates in the borehole. Alternatively, the borehole can be logged to determine the photoelectric absorption of the formation surrounding the borehole, and this log can be compared with data derived from scanning the core sample with a CAT at two different energy levels.

11 Claims, 8 Drawing Figures

FIG. 4
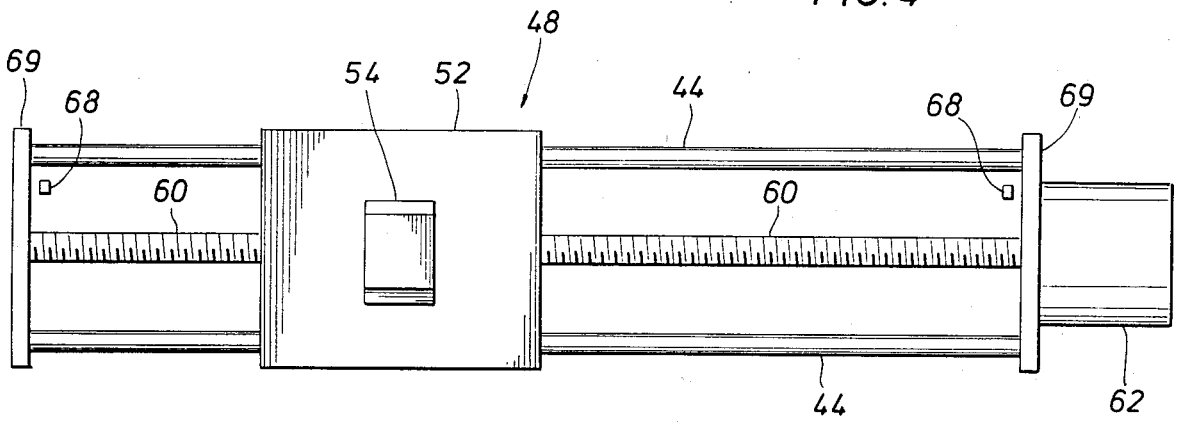
FIG. 5
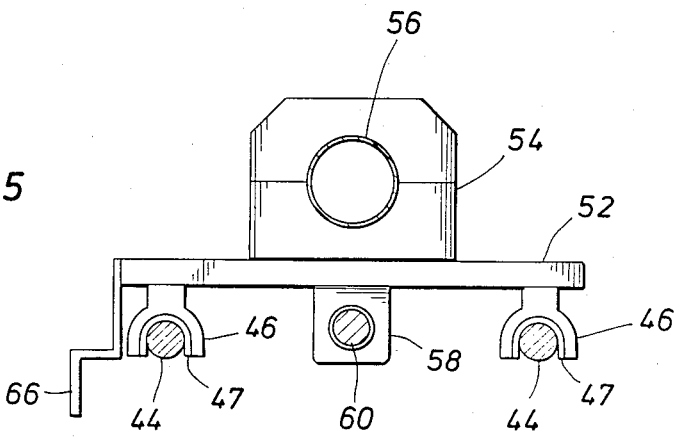
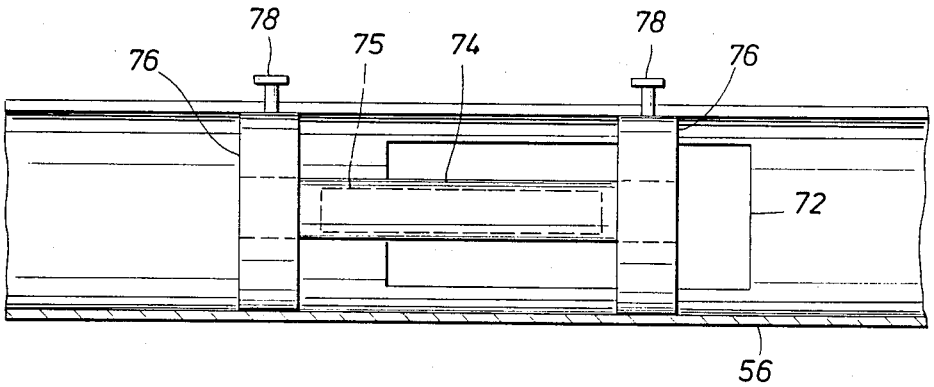
FIG. 6

METHOD OF CORRELATING A CORE SAMPLE WITH ITS ORIGINAL POSITION IN A BOREHOLE

BACKGROUND OF THE INVENTION

In a conventional coring operation a certain amount of core material is usually lost, thus making it difficult to correlate the remaining material with the well logs to identify the original depth or position of the core sample. The information provided by laboratory core analysis is of reduced value when the particular sample cannot be properly correlated with the other information about the borehole.

Therefore, it is an object of the present invention to provide a method of correlating a core sample with its original position in a borehole.

SUMMARY OF THE INVENTION

In accordance with the present invention there is provided a method of correlating a core sample with its original position in a borehole. The borehole is logged to determine the bulk density of the formation surrounding the borehole. The core sample is scanned with a computerized axial tomographic scanner, hereinafter referred to as "CAT," to determine the attenuation coefficients at a plurality of points in a plurality of cross sections along the core sample. The bulk density log is then compared with the attenuation coefficients to determine the position to which the core sample correlates in the borehole.

In addition, the present invention provides a method of correlating a core sample with its original position in a borehole in which the borehole is logged to determine the photoelectric absorption of the formation surrounding the borehole. The core sample is scanned with a CAT at first and second energies to determine the attenuation coefficients for a plurality of points in a plurality of cross sections along the core sample at the first and second energies. These attenuation coefficients are used to determine the effective atomic numbers for the plurality of cross sections along the core. The photoelectric absorption log is compared with the effective atomic numbers that have been determined to determine the position to which the core sample correlates in the borehole.

The data obtained with the CAT is on a small length scale, such as millimeters; it is processed to match the larger length scale, which is generally feet, obtained with the logging tools. The CAT images can be correlated with either a bulk density log or a photoelectric log. The correlation with the bulk density log is direct since both measure the amount of Compton scattering which is proportional to the bulk density. In order to correlate CAT scans with the photoelectric log, CAT scans are performed at two different X-ray tube energies. One scan is performed at an energy that is low enough to be predominantly in the photoelectric region, that is, less than approximately 80 keV mean energy, and the other scan is performed at an energy that is high enough to be predominantly in the Compton region, that is, greater than approximately 80 keV mean energy. Either pre-imaging or post-imaging techniques can be applied to the attenuation coefficients obtained by the dual energy scans to determine the effective atomic number of the core sample.

Other objectives, advantages and applications of the present invention will be made apparent by the following detailed description of the preferred embodiments of the present invention.

Brief Description of the Drawings

FIG. 4 is a top view of the motorized side of the sample holding apparatus.

FIG. 5 is a cross sectional view taken along lines 5—5 of FIG. 2.

FIG. 6 is a side view of the tube and cylinder portion of the sample holding apparatus.

DETAILED DESCRIPTION OF THE PREFERRED EMBODIMENTS

Figure 1:
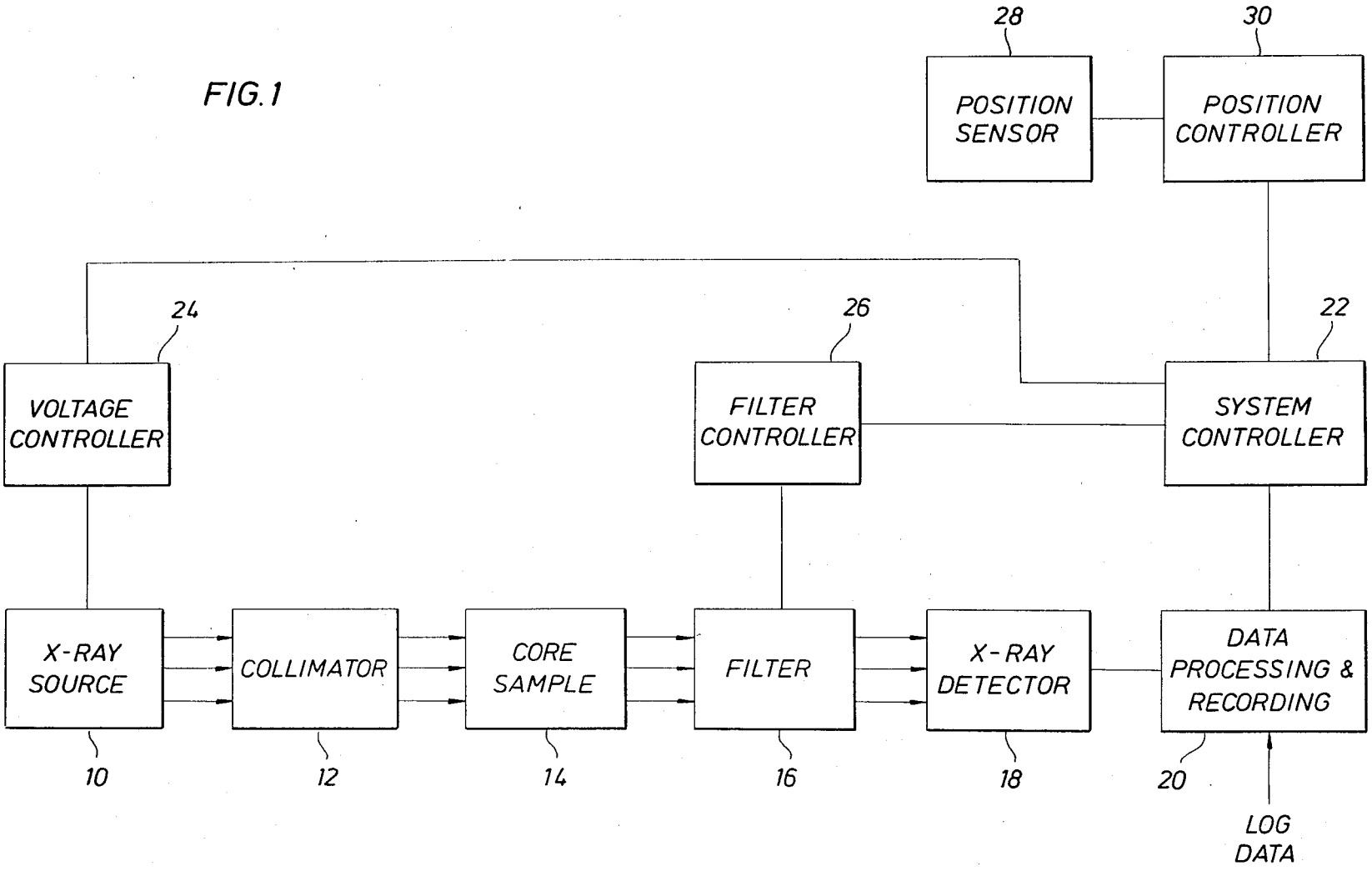
FIG. 1 is a block diagram of the computerized axial tomographic analyzer utilized in the method of the present invention.
Figure 2:
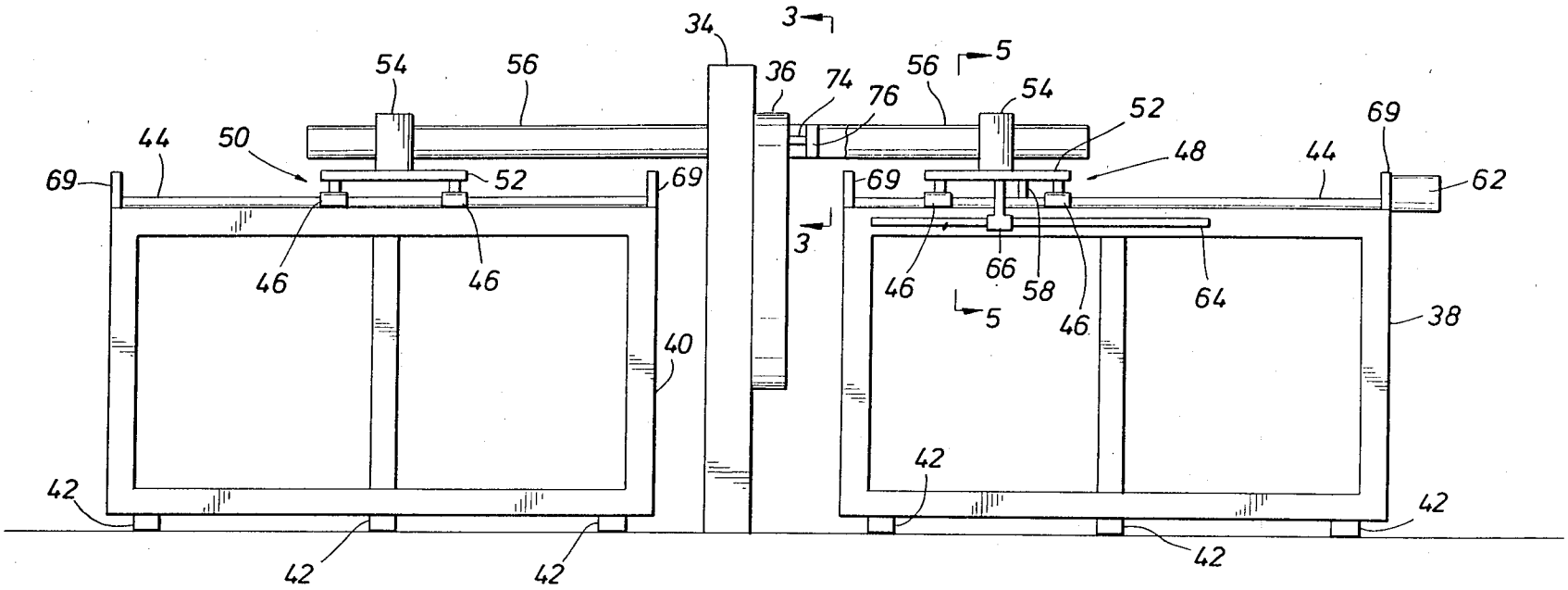
FIG. 2 is a side view of the sample holding apparatus employed with the computerized axial tomographic analyzer.
Figure 3:
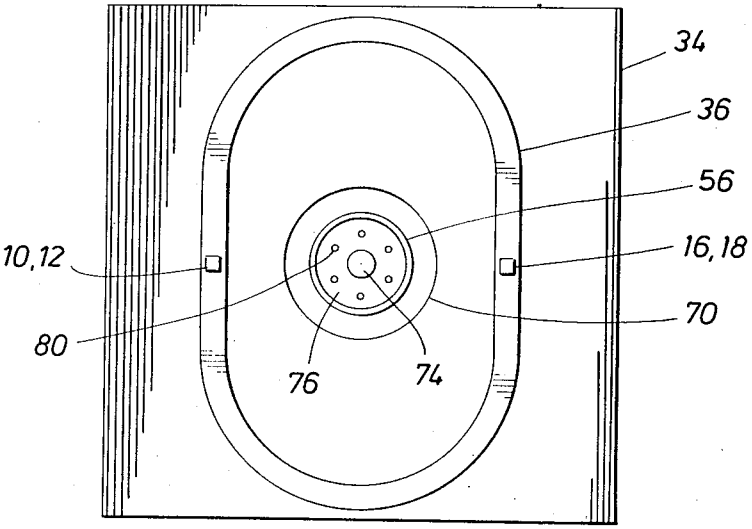
FIG. 3 is a cross sectional view taken along lines 3—3 of FIG. 2.

Referring to FIG. 1, a typical CAT employs an X-ray source 10 to provide X-rays which are indicated by a plurality of arrows; these X-rays are collimated by collimator 12 prior to passing through core sample 14. After the X-rays have passed through core sample 14, they are filtered by filter 16 which can be, for example, air, tungsten or copper. Alternatively, filter 16 can be applied to the X-rays prior to their entering core sample 14 rather than after their passage through core sample 14. The filtered X-rays are then detected by X-ray detectors 18 which generate signals indicative thereof; these signals are provided to suitable data processing and recording equipment 20. The entire operation, from the generation of the X-rays to the processing of the data is under the control of system controller 22. Suitable signals are provided by system controller 22 to voltage controller 24 which controls the voltage applied to X-ray source 10, thereby controlling the energy range of the X-rays. Alternatively, filter 16 can be used to vary the energy range as is known in the art. System controller 22 also provides suitable control signals to filter controller 26 to apply to appropriate filter to the X-rays which have passed through core sample 14 before they are detected by X-ray detector 18. The point along core sample 14 that is being analyzed is detected by sample position sensor 28 which provides signals indicative thereof to sample position controller 30. System controller 22 provides signals which are indicative of the desired point along core sample 14 or the amount of advancement from the last point analyzed, to sample position controller 30, which moves core sample 14 to the proper location.

Referring now to FIGS. 2–6, a suitable CAT and sample positioning system for use in the present invention is shown in detail. A typical CAT, for example, the Deltascan-100 manufactured by Technicare Corporation of Cleveland, Ohio is indicated by numeral 34. CAT 34 has a gantry 36 which contains X-ray source 10, collimator 12, filter 16 and X-ray detectors 18. Support structures or tables 38 and 40 are located on opposite sides of CAT 34 and have legs 42 which are suitably attached to, for example, the floor, to ensure that tables 38 and 40 maintain proper positioning and alignment with CAT 34. Tables 38 and 40 each have a set of guide means or rails 44, such as one inch diameter solid 60 case shafts mounted on shaft supports, Model No. SR-16, both being manufactured by Thomson Industries, Inc. of Manhasset, N.Y., on which the legs 46 of trolleys 48 and 50 ride. Preferably, legs 46 have a contact portion 47 that includes ball bearings in a nylon enclosure such as the Ball Bushing Pillow Block, Model No. PBO-16-OPN, which are also manufactured by Thomson. Trolleys 48 and 50 have a flat member 52 which is attached to legs 46 such that member 52 is parallel to rails 44. A member 54 which can consist of two pieces fastened together by suitable means, such as screws, is mounted on member 52 and has an aperture suitable for holding tube 56. Member 52 of trolley 48 has a member 58 attached to the bottom portion of member 52 that is provided with suitable screw threads for mating with gear or screw 60. Screw 60 is driven by motor 62 for moving trolley 48 horizontally. Screw 60 can be, for example, a preloaded ball bearing screw, Model No. R-0705-72-F-W, manufactured by Warner Electric Brake & Clutch Company of Beloit, Wis., and motor 62 can be, for example, a DC motor, Model No. 1165-01DCMO/E1000MB/X2, marketed by Aerotech, Inc. of Pittsburgh, Pa. Motor 62 turns a predetermined number of degrees of revolution in response to a signal from sample position controller 30 of FIG. 1, which can be, for example, a Unidex Drive, Model No. SA/SL/C/W/6020/DC-O/F/BR/R*, which is also marketed by Aerotech. Table 38 and trolley 48 also contain an optical encoding position sensing system, for example, the Acu-Rite-II manufactured by Bausch and Lomb Company of Rochester, N.Y. which comprises a fixed ruler or scale 64 attached to table 38 and an eye or sensor 66 attached to member 52 of trolley 48 for determining the position along ruler 64 at which trolley 48 is located. The digital output from optical sensor 66 is provided to sample position controller 30 of FIG. 1 so that sample position controller 30 can compare this with the desired position indicated by the digital signal from system controller 22 and provide appropriate control signals to motor 62 for rotation of screw 60 to accurately position trolley 48. Table 38 can also be provided with limit switches 68 which provide appropriate control signals to sample position controller 30 which limits the length of travel of trolley 48 from hitting stops 69 on table 38.

Tube 56 is centered in the X-ray field 70 of CAT 34. The attachment of tube 56 to members 54 of trolley 48 and 50 by a screw or other suitable fastening means causes trolley 50 to move when trolley 48 is moved by means of screw 60 and motor 62. Tube 56 which preferably is made of material that is optically transparent and mechanically strong and has a low X-ray absorption, for example, Plexiglas, has a removable window 72 to facilitate the positioning of sample holder 74 in tube 56. A core sample 75 is positioned in sample holder 74 as indicated by dotted lines. The ends of sample holder 74 are positioned in central apertures of discs 76, which can be made of a low friction material, for example, nylon, and are sized such that they make a close sliding fit to ensure centering of the sample inside tube 56. Discs 76 are locked in position in tube 56 by screws 78 which can be made of, for example, nylon. In addition, discs 76 can be provided with a plurality of apertures 80 sized to accommodate fluid lines and electrical power lines from various equipment associated with sample holder 74.

Sample holder 74 can be a pressure-preserving, core-sample container used in normal coring operations; however, if standard X-ray energy associated with CAT scan analytic equipment, such as the Deltascan-100 mentioned hereinabove, the pressure vessel must be made of material that will allow the X-rays to pass through the container walls, for example aluminum, beryllium or alumina. Aluminum is preferred because it absorbs a portion of the low energy spectra, thus making the beam more monochromatic. Nevertheless, steel pressure containers can be employed if higher energy X-ray tubes or radioactive sources are used. Alternatively, sample holder 74 can be replaced by any unpressurized or unsealed container which is suitable for holding a core sample or other material in a fixed position. In the case of a frozen core sample the container can be positioned inside an insulating cylinder which can be made of, for example, styrofoam or other insulating materials with low X-ray absorption. This insulating cylinder can be filled with dry ice or the like to keep the core sample frozen. If it is desired to heat a core sample, a heating element which has a low X-ray absorption, such as the heating foil manufactured by Minco Products, Inc, of Minneapolis, Minn., can be wrapped around the container to heat the sample and a similar insulating cylinder can be used.

Referring to the block diagram of FIG. 1, system controller 22 provides suitable signals to sample position controller 30 to advance core sample 14 a predetermined amount. At each of these locations a plurality of X-ray scans are taken as is known in the art of CAT scan analysis and X-ray detectors 18 provide signals indicative of the X-rays sensed to data processing and recording equipment 20. In addition, the log data obtained from the borehole along with the response function of the logging tool used to obtain such information is provided to data processing and recording equipment 20. In the case of the bulk density log a logging tool, such as the FDC-formation density compensated logging tool of Schlumberger Limited, New York, N.Y., can be used, The linear attenuation coefficients obtained from the CAT scan are directly proportional to the density values of the core. These density values which are determined for a plurality of points in a plurality of cross sections along the core by the CAT are averaged in each cross section. An interpolation of density values is then made between consecutive locations, $x_i$. The interpolated density values, f(x), are then convolved with the response function of the tool, R(x), to obtain the convolved density value, F(x), as indicated by equation (1):

$$F(x) = \int_{-\infty}^{\infty} f(x)R(x-s)ds \tag{1}$$

The response function for the tool used in the logging of the borehole can be, for example, $$R(x) = \frac{1}{L}\,\mathrm{box}_L(x) \tag{2a}$$

or

-continued $$R(x) = \frac{e^{-\frac{(x)2}{2\sigma 2}}}{\sigma\sqrt{2\pi}} \quad (2b)$$

where 1/L $box_L$ (x) is the normalized box function of width L and $\sigma$ is the standard deviation of the Gaussian. The convolved density values, F(x), are then cross correlated with the log density values, G(x), to obtain the maximum of the cross correlation function, $\phi_{FG}$(d), as indicated in equation (3):

$$\phi_{FG}(d) = \int_{-\infty}^{\infty} F(x) \cdot G(x + d)dx \quad (3)$$

The value of d at which $\phi_{FG}$ is a maximum is the correlation depth.

In the case of a photoelectric log a logging tool, such as the LDT-lithodensity logging tool of Schlumberger Limited, New York, N.Y., can be used. CAT scans are performed at two different X-ray tube energies. One scan is performed at an energy that is low enough to be predominantly in the photoelectric region, that is, less than approximately 80 keV mean energy, and the other scan is performed at an energy that is high enough to be predominantly in the Compton region, that is, greater than approximately 80 keV mean energy. Either pre-imaging or post -imaging techniques can be applied to the attenuation coefficients obtained by the dual energy scans to determine the effective atomic number of the core sample. For example, the techniques of Alvarez et al, U.S. Pat. No. 4,029,963, can be used to determine the effective atomic numbers for the plurality of points in each cross section. Preferably, the effective atomic numbers are determined according to the method described hereinbelow.

The energy dependence of the X-ray linear attenuation coefficient $\mu$ is separated into two parts:

$$\mu = \mu_p + \mu_c \quad (4)$$

where $\mu_c$ is the Klein-Nishina function for Compton scattering multiplied by electron density, and $\mu_p$ represents photoelectric absorption (including coherent scattering and binding energy corrections). The photoelectric and Compton contributions are expressed in the form:

$$\mu = aZ^m\rho + b\rho \quad (5)$$

where Z is the atomic number, m is a constant in the range of 3.0 to 4.0, $\rho$ is the electron density, and a and b are energy-dependent coefficients. It should be noted that the specific choice of m depends upon the atomic numbers included in the regression of the photoelectric coefficients. Equation (5) depends on the fact that the energy dependence of the photoelectric cross section is the same for all elements. Hydrogen is an exception, but it has negligible contribution to the effective atomic number.

For a single element, Z in equation (5) is the actual atomic number. For a mixture containing several elements, the effective atomic number Z* is defined as:

$$Z^* = \sqrt[m]{\sum_i f_i Z_i^m} \quad (6)$$

where $f_i$ is the fraction of electrons on the $i^{th}$ element of atomic number $Z_i$, relative to the total number of electrons in the mixture, that is, $$f_i = \frac{n_i Z_i}{\sum_i n_i Z_i} \quad (7)$$

where $n_i$ is the number of moles of element i.

The method consists of utilizing a CAT to image a core sample at a high and low X-ray energy level. The energies are chosen to maximize the difference in photoelectric and Compton contributions while still allowing sufficient photon flux to obtain good image quality at the lower X-ray energy. Letting 1 and 2 denote the high and low energy images and dividing equation (5) by $\rho$, the following relationships are obtained $$\mu_1/\rho = a_1 Z^3 + b_1 \quad (8a)$$

$$\mu_2/\rho = a_2 Z^3 + b_2 \quad (8b)$$

Energy coefficients ($a_1$, $b_1$) and ($a_2$, $b_2$) are determined by linear regression of $\mu/\rho$ on $Z^3$ for the high and low energy images, respectively, of calibration materials with a range of known atomic numbers and densities. Once ($a_1$, $b_1$) and ($a_2$, $b_2$) are determined, a material of unknown effective atomic number, $Z_x^*$, can be analyzed in terms of the measured attenuation coefficients $\mu_{1x}$, $\mu_{2x}$:

$$Z_x^* = \sqrt[3]{\frac{1}{a_1}\left(\frac{\mu_{1x}}{\rho} - b_1\right)} = \sqrt[3]{\frac{-b_1\mu_{2x} + b_2\mu_{1x}}{a_1\mu_{2x} - a_2\mu_{1x}}} \quad (9)$$

Equations (8a) and (8b) are applied to each corresponding pixel of the high and low energy images; these computations can be performed on a minicomputer or other suitable means.

Figure 7:
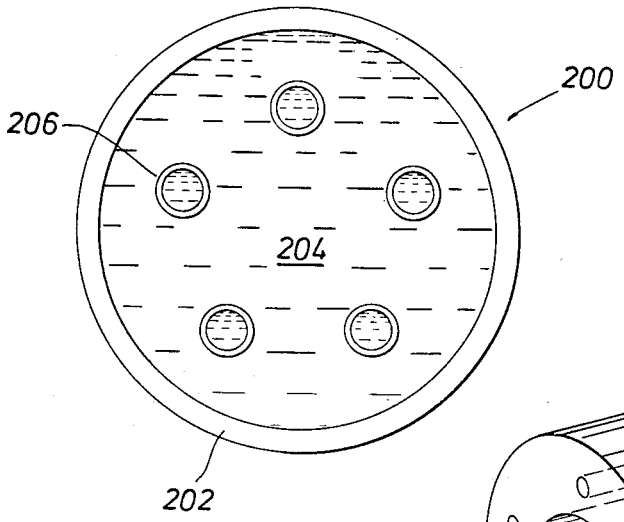
FIG. 7 illustrates a calibration phantom for use with the preferred method of correlating the core sample with the photoelectric log.

FIG. 7 shows an exemplary phantom 200 used in this method to determine energydependent coefficients a and b. Phantom 200 consists of a housing 202 made of, for example, Plexiglas, which is filled with a liquid 204, for example, water. A number, in this case five, smaller containers or vials 206 are positioned in liquid 204. Each vial 206 is filled with suitable calibration materials for the sample to be analyzed which have known densities and effective atomic numbers. The range of the effective atomic numbers should be chosen to span those of the sample being tested. For example, typical sedimentary rocks have an effective atomic number in the range of 7.5–15.0 and a density in the range of 1.5–3.0 grams per cubic centimeter.

Figure 8:
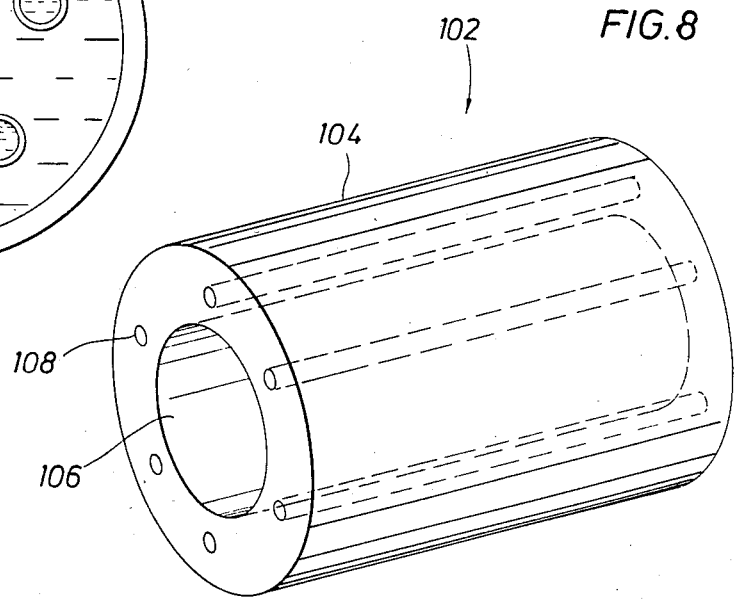
FIG. 8 illustrates a calibration phantom for use with the preferred method of correlating the core sample with the photoelectric log.

FIG. 8 illustrates a preferred embodiment of a phantom for use with this method. Calibration phantom 102 consists of a cylinder 104 which has an aperture 106 that is suitably sized for holding a sample or sample container. Cylinder 104 which can be made of, for example, plexiglas or other suitable material having low X-ray absorption, contains a plurality of vials or rods 108. Vials or rods 108 should contain or be made of material that is expected to be found in the sample under test. The calibration materials in vials or rods 108 have known densities and effective atomic numbers and should be at least as long as the sample under test. In the case of a core sample rods 108 can be made of aluminum, carbon, fused quartz, crystalline quartz, calcium carbonate, magnesium carbonate and iron carbonate. Alternatively, vials 108 could contain the liquid materials contained in vials 206 of FIG. 7. Referring to FIGS. 2–6 and 8, cylinder 104 can be positioned around tube 56 or it can be an integral part of tube 56. Still further, it can be an integral part of sample holder 74 or positioned in some other known relation in X-ray field 70. It should be noted that calibration phantom 102 is scanned at the same time that the sample is scanned.

Alternatively, the attenuation coefficients measured for the core sample at the low and high energies can be applied to equation (5), and the low energy equation can be divided by the high energy equation to provide a result that is proportional to the effective atomic number raised to the third power. This result is suitable for correlation with the well logs. The effective atomic numbers for the plurality of points in each cross section are averaged to obtain an average effective atomic number for the cross section. An interpolation of the average effective atomic numbers is then made between consecutive locations, $x_i$. The interpolated effective atomic numbers, f(x), are then convolved with the response function of the tool, R(x), to obtain the convolved effective atomic number F(x), as indicated by equation (1). The response function for the tool used in the logging of the borehole can be, for example, the response functions defined in equations (2a) and (2b). The convolved effective atomic numbers, F(x), are then cross correlated with the photoelectric log values, G(x), to obtain the maximum of the cross correlation function, $\phi_{FG}(d)$ as indicated in equation (3). The value of d at which $\phi_{FG}$ is a maximum is the correlation depth.

The portion of the core sample that has been invaded by the drilling fluid can be omitted from the calculation of the average effective number for a cross section. The amount of invasion can be determined in several ways. For example, an operator can review the effective atomic number image for the plurality of points in each cross section to determine the depth of invasion; the invaded portion of the core can be eliminated from the further calculations by providing suitable entries to the CAT system controller to remove those pixels from further calculations. Alternatively, only a portion of the core sample can be used in the analysis. This can be accomplished by providing suitable instructions to the CAT system controller to include only a predetermined portion of the core in the analysis. For example, the calculations of the average effective atomic number for each cross section can include only the plurality of points that are within a predetermined radius. This radius is chosen to ensure that the fluid invaded portion of the core is not included in the averaging. Still further, the CAT system controller and data processing equipment can implement a system which automatically excludes the portion of the core that has been invaded by the drilling fluid. A center portion of the core is chosen as the reference, for example, the area defined by the radius of the core divided by four. The average effective atomic number for the reference area for each cross section is determined. Then the average effective atomic number for successively larger annular rings for that cross section are determined and compared with the reference. The annular rings can be increased, for example, by the amount of the radius of the core divided by sixteen. When an annular ring has an average effective atomic number that differs from a predetermined amount, for example, five percent, of the average effective atomic number of the reference area of the core, the system stops analyzing the annular rings and eliminates the annular ring which exceeds the predetermined limit and the remainder of the core from any further calculations for that cross section of the core. The average effective atomic number of a respective cross section is then determined by averaging the effective atomic numbers for the portion of the cross section which includes the reference area and all annular rings that do not exceed the predetermined limit. If desired, a material having an effective atomic number that is different than the effective atomic number of the connate fluids in the rock formation surrounding the borehole, for example, barium sulfate, calcium carbonate, sodium tungstate or sodium iodide, can be added to the drilling fluid to enhance the portion of the core that has been invaded.

In any of the foregoing methods the mean X-ray energy of the CAT can be chosen to be equal to the mean X-ray energy or energies of the logging tool employed to log the borehole.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. A method of correlating a core sample with its original position in a borehole, said method comprising the steps of: logging the borehole to determine the bulk density of the formation surrounding the borehole; scanning the core sample with a computerized axial tomographic scanner to determine the attenuation coefficients at a plurality of points in a plurality of cross sections along said core sample; comparing the bulk density log determined in said logging step with the plurality of attenuation coefficients determined in said scanning step to determine the position to which said core sample correlates in said borehole.

2. A method as recited in claim 1, wherein said comparing step comprises determining the average attenuation coefficient for each cross section in said plurality of cross sections an interpolating between the average attenuation coefficients for adjacent cross sections in said plurality of cross sections to generate an interpolated-average attenuation coefficient function.

3. A method as recited in claim 2, wherein said comparing step comprises convolving the interpolated-average attenuation coefficient function with the response function of the logging tool used in said logging step to generate a convolved attenuation coefficient function.

4. A method as recited in claim 3, wherein said comparing step comprises determining the maximum of the cross correlation function of the values obtained in said logging step with the convolved attenuation coefficient function.

5. A method of correlating a core sample with its original position in a borehole, said method comprising the steps of: logging the borehole to determine the photoelectric absorption of the formation surrounding the borehole; scanning said core sample with a computerized axial tomographic scanner (CAT) at a first energy to determine the attenuation coefficients at a plurality of points in a plurality of cross sections along said core sample at said first energy; scanning said core sample with a CAT at a second energy to determine the attenuation coefficients at said plurality of points in said plurality of cross sections along said core sample at said second energy; using the attenuation coefficients determined for said core sample at said first and second energies for said plurality of points in said plurality of cross sections along said core sample to determine the effective atomic numbers for said plurality of points in said plurality of cross sections along said core sample; comparing the photoelectric absorption log determined in said logging step with the effective atomic numbers determined in said using step to determine the position to which said core sample correlates in said borehole.

6. A method as recited in claim 5, wherein said using step comprises determining the average effective atomic number for each cross section in said plurality of cross sections and interpolating between the average effective atomic numbers for adjacent cross sections in said plurality of cross sections to generate an interpolated-average effective atomic number function.

7. A method as recited in claim 6, wherein said comparing step comprises convolving the interpolated-average effective atomic number function with the response function of the logging tool used in said logging step to generate a convolved effective atomic number function.

8. A method as recited in claim 7, wherein said comparing step comprises determining the maximum of the cross correlation function of the values obtained in said logging step with the convolved effective atomic number function.

9. A method as recited in claim 8, further comprising the step of determining the portion of each cross section in said plurality of cross sections of the core sample that has been invaded drilling fluid and eliminating the portions of the cross sections that have been invaded by the drilling fluids from said step of determining the average effective atomic number for each cross section in said plurality of cross sections.

10. A method as recited in claim 8, wherein said steps of scanning said core sample at said first and second energies are performed with mean X-ray energies that are equal to the X-ray energies of the logging tool used in said logging step.

11. A method as recited in claim 5, wherein said scanning step is performed with a mean X-ray energy that is equal to the mean X-ray energy of the logging tool used in said logging step.

* * * * *